US008033258B2

(12) United States Patent
Yi

(10) Patent No.: US 8,033,258 B2
(45) Date of Patent: Oct. 11, 2011

(54) OIL CIRCUIT FOR CONTINUOUS VARIABLE VALVE TIMING DEVICE

(75) Inventor: Jea Woong Yi, Uiwang-si (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 359 days.

(21) Appl. No.: 12/337,182

(22) Filed: Dec. 17, 2008

(65) Prior Publication Data

US 2010/0024751 A1 Feb. 4, 2010

(30) Foreign Application Priority Data

Jul. 30, 2008 (KR) ..... 10-2008-0074478

(51) Int. Cl.
*F01M 9/10* (2006.01)

(52) U.S. Cl. ..... 123/90.33; 123/90.15; 123/90.17; 123/90.31

(58) Field of Classification Search ..... 123/90.33, 123/90.15, 90.17, 90.31
See application file for complete search history.

(56) References Cited

U.S. PATENT DOCUMENTS 6,662,771 B2 * 12/2003 Kobayashi ..... 123/90.33
6,823,825 B1 * 11/2004 Hwang et al. ..... 123/90.15

FOREIGN PATENT DOCUMENTS

JP 04-301112 10/1992
KR 1020050064047 A 6/2005
KR 1020060000641 A 1/2006
KR 100783540 B1 12/2007

* cited by examiner

*Primary Examiner* — Zelalem Eshete
(74) *Attorney, Agent, or Firm* — Morgan, Lewis & Bockius LLP

(57) ABSTRACT

An oil circuit for a continuous variable valve timing (CVVT) device includes a main oil passage from a cylinder block toward a cylinder head to feed oil from a main gallery to a cam shaft, and a control oil passage branching off from the main oil passage on a side of the cylinder block and formed so as to feed the oil from the main oil passage to the continuous variable valve timing devices via an intake-side oil control valve and an exhaust-side oil control valve. The oil is fed to the cam shaft, the intake-side CVVT device, the exhaust-side CVVT device and a timing chain tensioner at one time. Thereby, the hydraulic pressure the hydraulic pressure applied to two cam shafts can be equally maintained, and the tension of a belt or a chain can be simultaneously regulated so as to improve the driving force of a crank.

14 Claims, 3 Drawing Sheets

OIL CIRCUIT FOR CONTINUOUS VARIABLE VALVE TIMING DEVICE

CROSS-REFERENCE TO RELATED APPLICATION

The present invention claims priority to Korean Patent Application No. 10-2008-0074478 filed Jul. 30, 2008, the entire contents of which application is incorporated herein for all purposes by this reference.

BACKGROUND OF THE INVENTION

1. Field of the Invention

The present invention relates to a continuous variable valve timing device and, more particularly, to an oil circuit for a continuous variable valve timing device.

2. Description of Related Art

A dual continuous variable valve timing (CVVT) device makes it possible to continuously regulate lift timing of intake and exhaust valves according to the operation state of an engine, thereby improving output of the engine, reducing harmful components of exhaust gas, and increasing fuel efficiency.

Responsiveness and operation of the CVVT device are ensured depending on whether or not hydraulic pressure of oil fed by an oil pump reaches an optimal time of point and is continuously transmitted. At this time, in the structure that simultaneously controls two variable mechanisms, i.e. intake and exhaust valves, a hydraulic circuit is required not only to be free from variation in hydraulic pressure if possible but also to be connected in parallel to one passage. Further, in order to drive a cam in cooperation with a crank, the cam must interact with the crank by means of a chain or a belt. In this case, tension of the chain or the belt transmitting a driving force must be also regulated.

In detail, in order to properly realize the CVVT device, hydraulic pressure applied to two cam shafts must be uniformly supplied and ensured to a predetermined level or more. If not so, malfunction caused by a time difference cannot be prevented. In order to accurately cooperate with the crank, the tension of a driving force transmitting means such as a belt or a chain must be simultaneously regulated even the moment the CVVT device is operated.

FIG. 1 illustrates an oil circuit for a conventional continuous variable valve timing (CVVT) device.

Referring to FIG. 1, the oil circuit for a CVVT device includes a main oil passage 120 disposed from a cylinder block toward a cylinder head and guiding oil fed from a main gallery 110, and an oil circuit 160 disposed on a side of the cylinder head to feed the oil passing through the main oil passage 120 to the CVVT device 150 by way of an oil filter 130 and an oil control valve 140.

However, the conventional CVVT device has problems in that, since the oil circuit 160 is disposed on the cylinder head side, the oil cannot be fed to a timing chain tensioner 170 in a non-CVVT device that is free of the oil circuit, and that, since the oil is separately fed to the cam shafts, the cooperation between the crank and the cam is correctly performed.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY OF THE INVENTION

Various aspects of the present invention are directed to provide an oil circuit for a continuous variable valve timing (CVVT) device, which drives an intake-side and exhaust-side continuous variable valve timing devices without a time difference.

There is provided an oil circuit for a CVVT device, which simultaneously regulates the tension of a belt or a chain when a cam cooperating with a crank is driven.

In an aspect of the present invention, the oil circuit for a CVVT device may include a main oil passage running from a cylinder block toward a cylinder head so as to feed oil from a main gallery to a cam shaft, and/or a control oil passage branching off from the main oil passage on a side of the cylinder block and configured to feed the oil from the main oil passage to the continuous variable valve timing devices via an intake-side oil control valve and an exhaust-side oil control valve.

The oil circuit may further include an intake-side oil filter installed on the control oil passage running toward an intake-side continuous variable valve timing device, and/or an exhaust-side oil filter installed on the control oil passage running toward an exhaust-side continuous variable valve timing device.

The intake-side oil filter may be disposed on the cylinder block. The intake-side oil filter may be exposed to an outside of an engine.

The intake-side oil filter may be disposed on the cylinder head. The intake-side oil filter may be exposed to an outside of an engine.

The exhaust-side oil filter may be disposed on the cylinder head. The exhaust-side oil filter is exposed to an outside of an engine.

The oil circuit may further include a tensioner oil passage branching off from the control oil passage that runs toward the exhaust-side continuous variable valve timing device on the side of the cylinder block to feed the oil to a timing chain tensioner.

The oil circuit may be operated independently of the timing chain tensioner.

The main oil passage may have about 1.5 times as large a diameter as the control oil passage has.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

DETAILED DESCRIPTION OF THE INVENTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Figure 1:
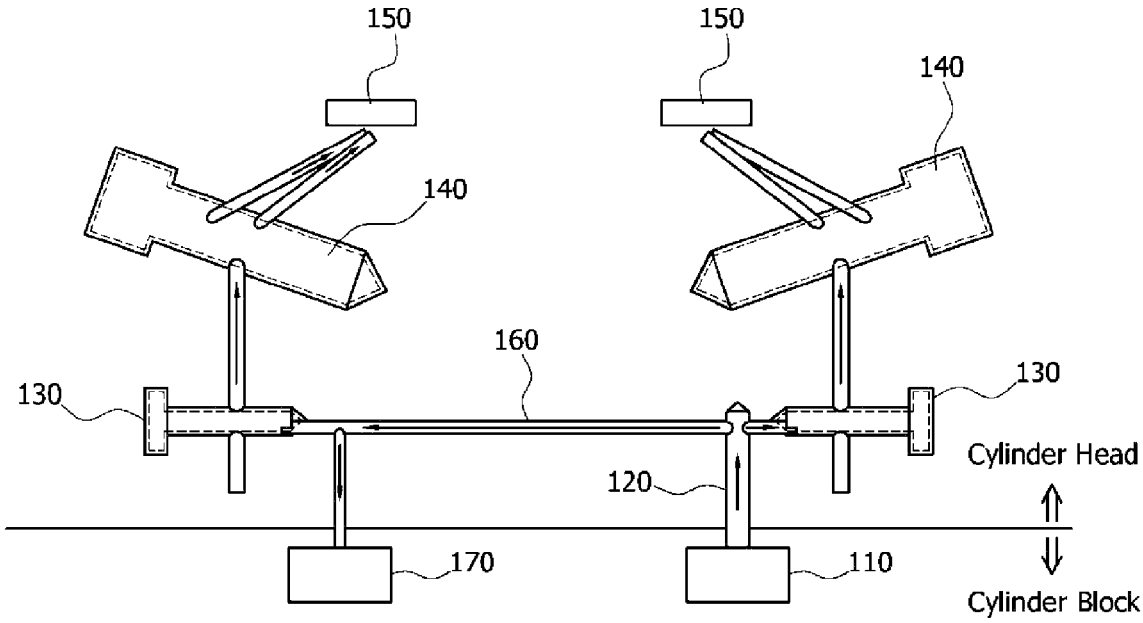
FIG. 1 illustrates an oil circuit for a conventional continuous variable valve timing (CVVT) device.
Figure 2:
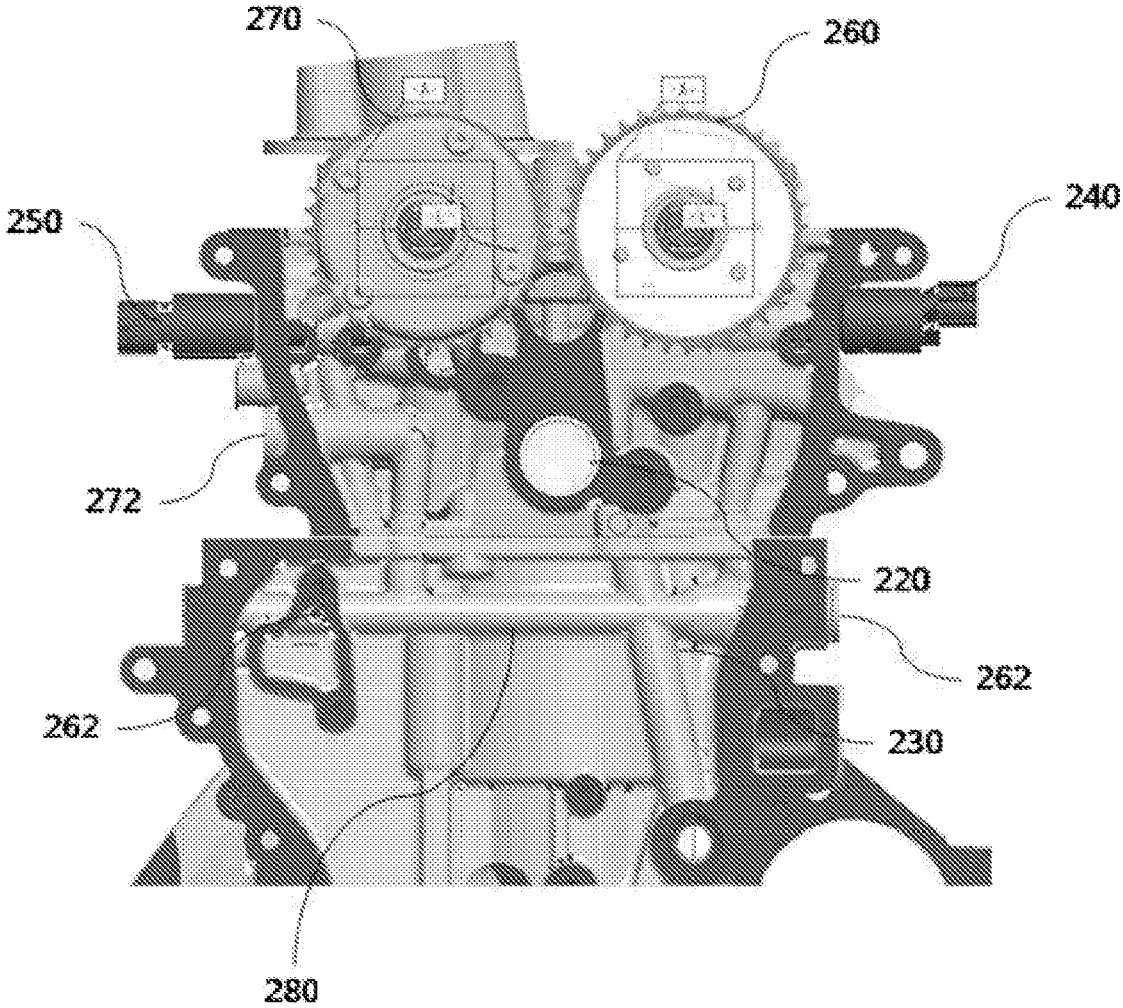
FIG. 2 illustrates the outer shape of an exemplary CVVT device according to the present invention.
Figure 3:
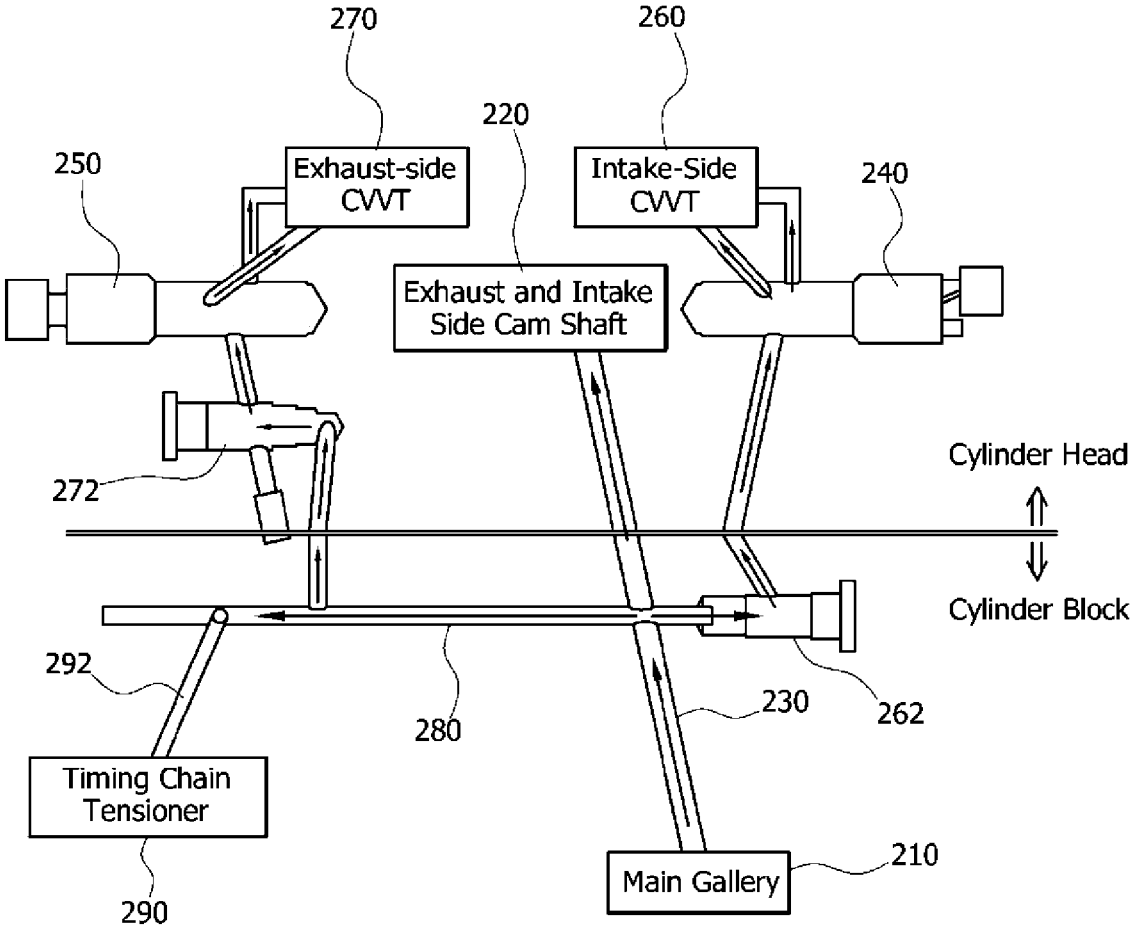
FIG. 3 illustrates an oil circuit for an exemplary CVVT device according to the present invention.

FIG. 2 illustrates the outer shape of a continuous variable valve timing (CVVT) device according to an exemplary embodiment of the present invention. FIG. 3 illustrates an oil circuit for a CVVT device according to various embodiments of the present invention.

Referring to FIG. 3, the oil circuit for a CVVT device according to various embodiments includes a main oil passage 230 formed so as to run from a cylinder block toward a cylinder head and feeding oil from a main gallery 210 to a cam shaft 220, and a control oil passage 280 branching off from the main oil passage 230 on the side of the cylinder block and formed so as to feed the oil from the main oil passage 230 to the CVVT devices 260 and 270 via an intake-side oil control valve 240 and an exhaust-side oil control valve 250.

Here, the main oil passage 230 has 1.5 times as large a diameter as the control oil passage 280 has. For example, the diameter of the main oil passage 230 is 9□, and the diameter of the control oil passage 280 is 6□. In this case, if the control oil passage 280 is larger than 6□, an area which the control oil passage 280 occupies within the CVVT device is unnecessarily increased, and thus can hinder installation of other parts. In contrast, if the control oil passage 280 is smaller than 6□, the oil may not be smoothly fed to each device.

Further, the CVVT device according to various embodiments further includes an intake-side oil filter 262 installed on the control oil passage 280 running toward the in the intake-side CVVT device 260, and an exhaust-side oil filter 272 installed on the control oil passage 280 running toward the exhaust-side CVVT device 270.

Preferably, the intake-side oil filter 262 is disposed on the cylinder block, and the exhaust-side oil filter 272 is disposed on the cylinder head. Thus, the exhaust-side CVVT device 270 and the exhaust-side oil filter 272 are disposed on the cylinder head, so that the design of a product can be easily modified. This disposition can be applied to a single CVVT device and a dual CVVT device, so that the productivity of products can be improved.

Further, according to various embodiments, the intake-side oil filter 262 and the exhaust-side oil filter 272 are exposed to the outside of an engine so as to be able to be coupled to and decoupled from the cylinder block and the cylinder head, respectively. Thus, when getting out of order, the filters can be repaired without disassembling the engine.

Further, the oil circuit for a CVVT device according to various embodiments of the present invention further includes a tensioner oil passage 292, which branches off from the control oil passage 280 that runs toward the exhaust-side CVVT device 270 on the side of the cylinder block, and which feeds the oil to a timing chain tensioner 290. Thus, in a non-CVVT device that is free of the oil circuit, the oil can be fed to the timing chain tensioner 290 via the oil control passage 280 displaced on the side of the cylinder block.

Thus, according to various embodiments of the present invention, the oil is fed to the cam shaft 220, the intake-side CVVT device 260, the exhaust-side CVVT device 270 and the timing chain tensioner 290 at one time. Thereby, the intake-side CVVT device 260 and the exhaust-side CVVT device 270 can be driven without a time difference, and the timing chain tensioner 290 can appropriately regulate tension of a belt or a chain in cooperation with a crank driven by the cam shaft 220.

For convenience in explanation and accurate definition in the appended claims, the terms "outside", and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. An oil circuit for a continuous variable valve timing device comprising:

a main oil passage running from a cylinder block toward a cylinder head so as to feed oil from a main gallery to a cam shaft;

a control oil passage branching off from the main oil passage on a side of the cylinder block and configured to feed the oil from the main oil passage to the continuous variable valve timing devices via an intake-side oil control valve and an exhaust-side oil control valve; and an intake-side oil filter installed on the control oil passage running toward an intake-side continuous variable valve timing device;

wherein the intake-side oil filter is disposed on the cylinder block.

2. The oil circuit according to claim 1, further comprising:

an intake-side oil filter installed on the control oil passage running toward an intake-side continuous variable valve timing device; and an exhaust-side oil filter installed on the control oil passage running toward an exhaust-side continuous variable valve timing device, wherein the intake-side oil filter is disposed on the cylinder block, and the exhaust-side oil filter is disposed on the cylinder head.

3. The oil circuit according to claim 2, wherein the intake-side oil filter and the exhaust-side oil filter are exposed to an outside of an engine so as to be able to be coupled to and decoupled from the cylinder block and the cylinder head, respectively.

4. The oil circuit according to claim 1, further comprising:

an exhaust-side oil filter installed on the control oil passage running toward an exhaust-side continuous variable valve timing device.

5. The oil circuit according to claim 1, wherein the intake-side oil filter is exposed to an outside of an engine.

6. The oil circuit according to claim 4, wherein the intake-side oil filter is disposed on the cylinder head.

7. The oil circuit according to claim 6, wherein the intake-side oil filter is exposed to an outside of an engine.

8. The oil circuit according to claim 4, wherein the exhaust-side oil filter is disposed on the cylinder head.

9. The oil circuit according to claim 8, wherein the exhaust-side oil filter is exposed to an outside of an engine.

10. The oil circuit according to claim 1, further comprising a tensioner oil passage branching off from the control oil passage that runs toward the exhaust-side continuous variable valve timing device on the side of the cylinder block to feed the oil to a timing chain tensioner.

11. The oil circuit according to claim 4, wherein the oil circuit is operated independently of the timing chain tensioner.

12. The oil circuit according to claim 1, wherein the main oil passage has about 1.5 times as large a diameter as the control oil passage has.

13. An engine comprising the oil circuit defined according to claim 1.

14. A passenger vehicle comprising the engine defined according to claim 13.

* * * * *